United States Patent [19]

Forker, Jr. et al.

[11] 3,965,323

[45] June 22, 1976

[54] METHOD AND APPARATUS FOR PROVIDING UNIFORM SURFACE BROWNING OF FOODSTUFF THROUGH MICROWAVE ENERGY

[75] Inventors: Ray B. Forker, Jr., Beaver Dams; Joseph N. Panzarino, Big Flats, both of N.Y.

[73] Assignee: Corning Glass Works, Corning, N.Y.

[22] Filed: Feb. 26, 1975

[21] Appl. No.: 553,317

[52] U.S. Cl. ..... 219/10.55 E; 99/DIG. 14

[51] Int. Cl.[2] ..... H05B 9/06

[58] Field of Search ..... 219/10.55 E, 10.55 F, 219/10.55 R, 10.55 M, 521; 425/174.2, 174.4, 174.6, 174.8; 426/107, 175, 177, 234, 241, 243; 99/DIG. 14

[56] References Cited

UNITED STATES PATENTS

| | | | |
|---|---|---|---|
| 2,714,070 | 7/1955 | Welch | 99/DIG. 14 |
| 3,219,460 | 11/1965 | Brown | 426/107 |
| 3,271,169 | 9/1966 | Baker et al. | 219/10.55 E |
| 3,302,632 | 2/1967 | Fichtner | 219/10.55 E X |
| 3,483,358 | 12/1969 | Eisler | 426/107 |
| 3,615,713 | 10/1971 | Stevenson | 426/107 |
| 3,725,645 | 4/1973 | Shevlin | 219/521 |
| 3,783,220 | 1/1974 | Tanizaki | 219/10.55 E |
| 3,853,612 | 12/1974 | Spanoudis | 219/10.55 E X |
| 3,854,023 | 8/1973 | Levinson | 219/10.55 E |
| 3,865,301 | 2/1975 | Pothier et al. | 99/DIG. 14 |
| 3,881,027 | 4/1975 | Levinson | 426/234 |

FOREIGN PATENTS OR APPLICATIONS

| | | | |
|---|---|---|---|
| 736,583 | 6/1966 | Canada | 219/10.55 E |
| 770,076 | 3/1957 | United Kingdom | 219/10.55 E |

*Primary Examiner*—Arthur T. Grimley
*Attorney, Agent, or Firm*—Burton R. Turner; Clarence R. Patty, Jr.

[57] ABSTRACT

Microwave energy is utilized to energize an electroconductive film on a surface of a microwave browning apparatus to brown surface portions of foodstuff retained within said apparatus by conducting heat from said energized film through said browning apparatus to surface portions of the foodstuff. The microwave browning apparatus is provided with a recess below the electroconductive film, substantially surrounded by support portions, which function to focus or redirect the microwave energy toward central portions of the film or coating on the browning apparatus so as to provide more uniform browning temperatures across the coated surface.

7 Claims, 4 Drawing Figures

METHOD AND APPARATUS FOR PROVIDING UNIFORM SURFACE BROWNING OF FOODSTUFF THROUGH MICROWAVE ENERGY

BACKGROUND OF THE INVENTION

Microwave cooking provides a rapid and efficient means of processing foodstuff, but generally does not result in surface browning of the food. In order to provide surface browning, some form of direct surface heating is required, such as by conduction through contact or by radiation.

Conventional means for providing browning with microwave energy typically comprises the use of a microwaveheatable apparatus in the microwave chamber which acts as a supplemental heating source to brown the food by radiation or conduction. Such an apparatus may become a supplemental heating source through the incorporation therewith of electroconductive members or portions which are heated by internal currents generated by the microwave energy.

A preferred form of microwave browning apparatus is a browning vessel such as a plate, platter, dish or pan composed of a glass, glass-ceramic or ceramic material to which an electroconductive coating or film has been applied, such as a tin oxide based coating. The film typically has an electrical resistance value in the range of about 90–350 ohms per square which renders it efficiently heatable in a microwave field. Upon exposure to microwave energy, the film becomes heated, and then through heat transfer the vessel is also heated to a degree sufficient to brown the surface of foodstuff contained therein in contact with the vessel. Although tin oxide coated glass microwave browning dishes have been available since the mid 1950's, U.S. Pat. No. 3,783,220 describes a presently known type of microwave browing vessel comprising a glass, ceramic or crystallized glass (a glass ceramic such as may be described in U.S. Pat. No. 2,920,971) vessel having a thin electroconductive coating of a tin oxide type upon its exterior surface. Tin oxide films, such as described in U.S. Pat. No. 2,564,706 to Mochel, consisting predominantly of tin oxide but also containing about 0.001–13% $Sb_2O_3$ by weight, are also suitable for such application.

Microwave browning vessels of the kind described in the beforementioned patent have become available commercially, but have not been completely satisfactory due to the fact that the thermal profile developed by the coated vessels produces a relatively cold central area within the bottom of the vessel having a temperature insufficient to effect browning of the foodstuff contained therein. That is, presently available coated vessels or dishes for browning foodstuffs in microwave ovens have relatively large temperature gradients across the bottom surface thereof, with low temperatures being exhibited in central areas, and high temperatures in outer peripheral areas. As a result, the bottom central areas of such dishes may be at temperatures which are insufficient to produce browning, whereas the outer peripheral areas are at elevated temperatures tending to over brown or burn the foodstuff.

The problem of a changing temperature distribution or temperature differential ($\Delta T$) over the bottom of known browning dishes may be exemplified by the fact that, for a given preheat time of about 6 minutes, it was only possible to obtain a maximum of about 40 square inches of acceptable browning area, whereas with the present invention upwards of 65 square inches of acceptable browning area are obtainable for the same preheat time. Although not concerned with the problem of temperature distribution across the bottom of a browning dish, U.S. Pat. No. 3,539,751 was concerned with the loss of heat energy from such a dish, and attempted to overcome such loss through the use of a separate insulating implement which reflected the heat back to foodstuffs within the dish.

The present invention overcomes the problems encountered in the prior art relative to uneven browning of foodstuff within coated microwave browning dishes for use in microwave ovens, by providing a novel recess in the bottom of the dish beneath the coating, wherein the recess is downwardly open and has bounding sidewalls which communicate at their upper extent with the coated bottom surface so as to focus and redirect the microwave energy applied to the chamber of a microwave oven across the coated surface of a dish positioned therewithin and produce a substantially uniform temperature profile across the bottom of such dish thus providing uniform browning of foodstuffs contained therein.

SUMMARY OF THE INVENTION

In its simplest form, the present invention is directed to an improved method and apparatus for providing uniform surface browning of foodstuff through microwave energy by redirecting or focusing the high energy electromagnetic radiation applied to a microwave oven chamber in such a manner so as to evenly heat an electroconductive film applied to an under surface of a dish positioned within such chamber, and thereby through conduction provide a substantially uniform temperature profile across the bottom of such dish.

The focusing or redirecting of the microwave energy substantially evenly across the bottom of the dish is accomplished by elevating the lower central bottom surface of the dish a minimum of about 0.65 inches above the lowermost support edge of the dish, and by forming a bottom-open recess within the dish below the lower central bottom surface and peripherally enclosing such recess with substantially continuous bounding sidewall portions which communicate with both the bottom surface of the vessel and the lowermost support edge thereof. By providing the peripherally bounded bottom-open recess below the coated surface and maintaining the coated surface at an elevation of at least 0.65 inches above the bottom of the microwave oven shelf, we have been able to obtain improved temperature uniformity across the bottom of such a microwave browning dish when subjected to electromagnetic radiation within a microwave oven cavity wherein, for a given preheat time, the useable browning area is not only materially increased but also the change in temperature across such surface is materially decreased, thus providing more efficient and uniform browning of foodstuff positioned upon such surface.

It thus has been an object of the present invention to overcome the problem of uneven browning of foodstuff within a microwave oven by redirecting or focusing microwave energy within an oven cavity by means of a bottom-open recess formed within a browning dish below an electroconductive coated surface thus forming an air pocket in communication with the coated area and focusing the electromagnetic radiation of the microwave energy on the electroconductive coated surface to produce substantially even heat.

DESCRIPTION OF THE PREFERRED EMBODIMENTS

Figure 1:
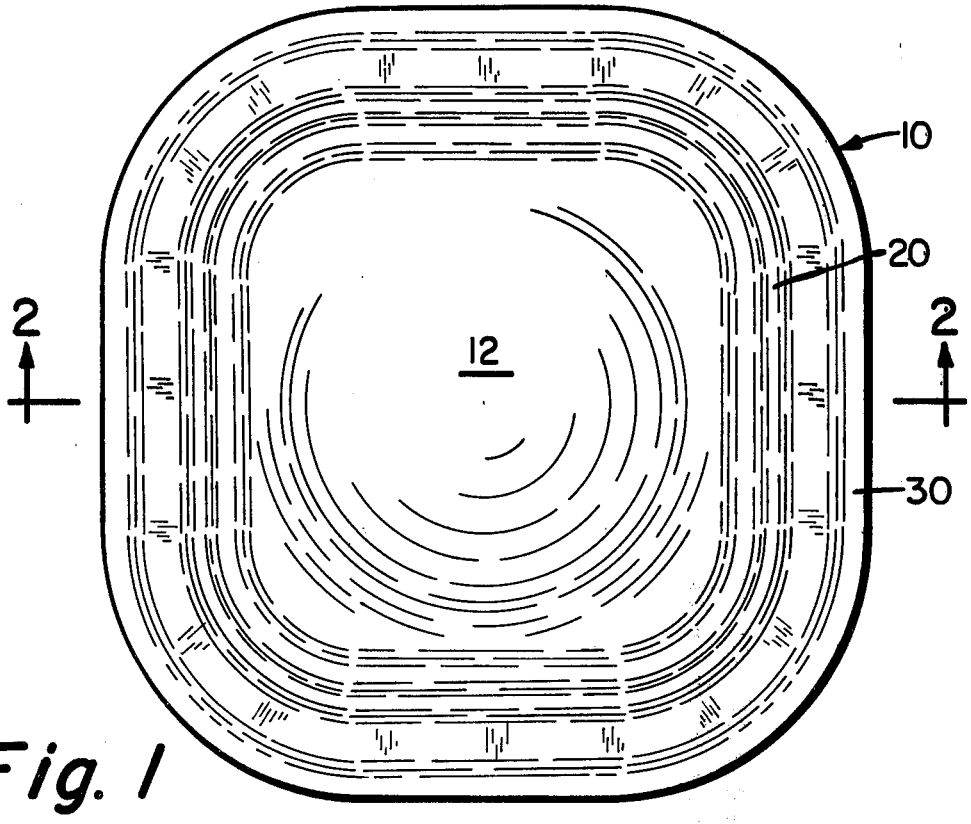
FIG. 1 is a top plan view of a microwave browning vessel in the form of a rounded-square dish embodying the present invention.
Figure 2:
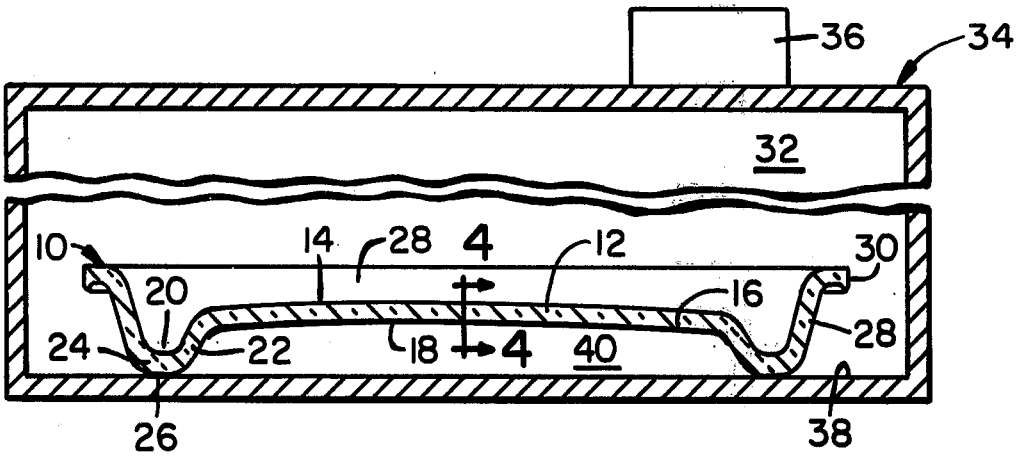
FIG. 2 is an elevational view in section taken along line 2—2 of FIG. 1 showing the dish positioned within a microwave oven cavity.
Figure 4:
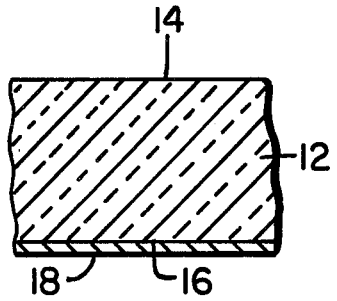
FIG. 4 is a greatly enlarged fragmental sectional view in elevational taken along line 4—4 of FIG. 2 illustrating the electroconductive coating formed on the lower surface of the central bottom portion of the browning dish shown in FIG. 2.

Referring now to the drawings, and particularly FIGS. 1 and 2, a microwave browning vessel 10 is shown in the form of a somewhat shallow square dish having rounded corners. The dish 10 has a central bottom wall portion 12 having an upper surface 14 for receiving foodstuff and a lower surface 16 provided with an electroconductive coating or film 18 (see also FIG. 4). The electroconductive coating is preferably of a high loss tin oxide based composition such as described in U.S. Pat. No. 2,564,706, whereas the vessel 10 is preferably of a high heat capacity material having relatively low heat conductivity such as glass ceramics made in accordance with U.S. Pat. No. 2,920,971. For example, such materials at 25°C. may have a specific heat of about 0.19 or higher and a thermal conductivity value of about 0.0047 cal./cm. sec. °C. or lower.

A trough area or U-shaped channel 20 is shown surrounding the outer extent of central bottom portion 12, and is formed by an inner bounding wall 22 extending downwardly from the central bottom portion to a channel bottom or foot portion 24 having a lowermost support edge surface 26, and an outer sidewall 28 terminating at its upper extent in a rim or flange portion 30. In FIG. 2, the vessel or dish 10 is shown positioned within the cavity or heating chamber 32 of a microwave oven 34 having a suitable high frequency generator 36 for supplying the cavity 32 with microwave energy in the form of electromagnetic radiation. The lowermost support surface 26 of the dish 10 is shown resting upon the bottom shelf 38 of the oven cavity 32. As shown in FIG. 2, the central bottom portion 12 is raised upwardly above the shelf 38 of cavity 32 and forms a bottom-open recess 40 in the dish 10 which is peripherally bounded by inner bounding wall 22.

The bottom-open recess 40 together with its bounding wall 22 focuses and redirects microwave energy supplied to cavity 32 by generator 36 toward the center of bottom wall portion 12, so as to distribute such energy substantially evenly across the electroconductive coating 18 and thereby produce substantially uniform browning temperatures to the entire central bottom wall portion 12. The lower surface 16 of bottom wall 12 must be raised at least about 0.65 inches above the bottom shelf 38 of the cavity 32 to obtain improved uniform browning, and preferably the surface 16 is raised above the lower surface 38 of the cavity a vertical displacement of about 0.65 inches to about 1.3 inches to optimize the browning effect.

Figure 3:
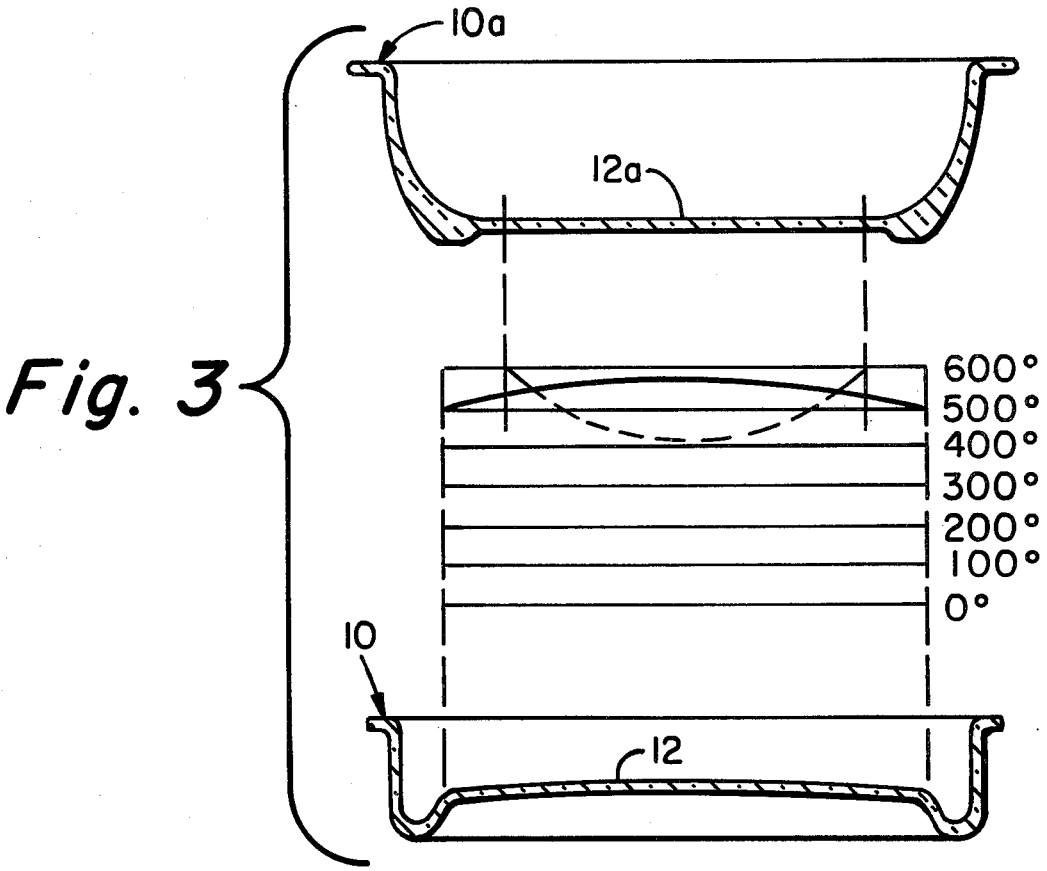
FIG. 3 is a somewhat schematic elevational view in section of a prior art dish and a dish of the present invention illustrating their relative temperature profiles.

FIG. 3 schematically illustrates the improved heat distribution obtained across the upper surface of the relatively large coated area of central bottom portion 12 of the dish 10 of the present invention as compared with the relatively small coated area of bottom portion **12*a* of a conventional dish 10*a* of the prior art. That is, when heating a conventional dish such as 10*a* having a suitable coating on the bottom thereof, within a microwave oven, the temperature distribution across the bottom portion 12*a* could have a ΔT of about 200°F. or more, with the central portion of the bottom being relatively cool with respect to annular peripheral portions. Accordingly, since a temperature of about 450°F. is necessary in order to obtain acceptable browning, central portions of foodstuffs placed in conventional dishes were not browned, whereas peripheral portions of such foodstuffs became over browned. As shown in FIG. 3, a typical temperature distribution across the smaller coated bottom area 12*a* of a conventional browning dish may vary from about 600°F. at the outer peripheral portions of the bottom down to about 400°F. in central portions thereof. Thus, when utilizing conventional browning dishes of the prior art it was necessary to limit the central browning portion to only about 30 to 35 square inches of useable space, or otherwise the temperature differential (ΔT) across the surface of the bottom portion was so great as to produce uneven browning with central portions of foodstuff exhibiting virtually no browning and outer portions thereof being over browned. The relative sizes of useable coated areas 12*a* and 12 is shown by the broken vertical graph lines for each dish 10*a* and 10** respectively.

By utilizing the novel configuration of the browning dish of the present invention, however, it is possible to utilize bottom areas of up to about 70 square inches of useable area having substantially uniform temperature distribution thereacross so as to provide uniform browning of foodstuff in contact therewith. That is, whereas the ΔT across the bottom of a conventional browning dish may be as high as 200°F., the ΔT produced with the present invention may be only 50°F. or less, and as further shown in FIG. 3 such uniform temperature distribution is applied over a much larger area than that obtained with conventional dishes.

By raising the coated undersurface 16 of the bottom portion 12 above the bottom shelf 38 of the microwave oven cavity 32 at least 0.65 inches and thereby forming the bottomopen recess 40 peripherally bounded by inner bounding walls 22, an air pocket is formed beneath the coated surface, and the pocket or focus effect or the combination of the two, causes a temperature shift from peripheral portions of the coated area toward a center portion thereof and promotes a uniform heating of the coated area thus facilitating the utilization of larger areas providing uniform browning. That is, the air pocket in conjunction with the bottom-open recess functions to homogenize the temperature distribution laterally across the dish, and since the dish is of a high heat capacity material having low heat conductivity, the heat generated in the lossy coating by the microwave energy is distributed uniformly to the upper surface 14 which is in contact with foodstuff. Accordingly, heat is transferred from the electroconductive coating 18 to the foodstuff through the central bottom wall portion by conduction. Further, in view of the fact that the coated surface is insulated from the bottom of the oven cavity by the air pocket, less heat is lost downwardly into the bottom of the oven cavity and more heat is therefore retained in the dish itself for heating the foodstuff contained therein.

Again referring to FIG. 3, it will be noted that the novel structure of the present invention surprisingly reverses the thermal profile produced by conventional dishes of the prior art and thus produces a more efficient, useful and improved performance microwave browning vessel. Since the thermal profile provides a more useable browning surface, the required preheat times can be materially shortened over those previously required while providing a more efficient and uniform product. That is, as previously mentioned, the temperature differential ($\Delta T$) across the bottom surface of the vessel of the present invention is much lower than the $\Delta T$ encountered with the prior art vessels. Alternately, larger areas of useable browning area are now available if the preheat times are not reduced but maintained at the same duration as those utilized with the prior art devices. In addition, the novel trough area or channel portion 20 permits the entrappment of grease and other run-off fluids in a low temperature area of the vessel, greatly reducing objectionable smoking meat stewing, browning blend out and meat cooling which would otherwise occur when meat juices surround the meat during cooking. In order to enhance the flow of such juices into the trough 20, the upper surface 14 is shown slightly convex.

The following is a tabulation of heat distributions, in average temperatures, across central bottom wall portions of dishes of the present invention and those of the prior art for various areas of useable browning surfaces, wherein the compared dishes were both heated for a period of 6 minutes in the same microwave oven at a rated power of 600 watts:

| | Present Invention | | | Browning | Prior Art Dish | | | Browning |
|---|---|---|---|---|---|---|---|---|
| Sq. Inches | Center | Outer | $\Delta T$ | Degree | Center | Outer | $\Delta T$ | Degree |
| 32.5 | 650 | 625 | 25 | Exc. | 450 | 650 | 200 | Good |
| 45 | 600 | 550 | 50 | Exc. | 350 | 600 | 250 | Fair |
| 50 | 490 | 524 | 14 | Exc. | 380 | 461 | 81 | Poor |
| 72 | 430 | 467 | 37 | Fair | 280 | 365 | 85 | None |

To further illustrate the advantages of the present invention a dish of the prior art was heated in a microwave oven for a period of 6 minutes and produced a maximum useable area of about 36 square inches having a range of 400°–600°F., or a $\Delta T$ of 200°F. Such a product produces nonuniformly browned meat foodstuffs. However, using the same preheat time in the same oven, a dish of the present invention produced a useable area of about 60 square inches having a temperature range of 500°–550°F., or a $\Delta T$ of 50°, and produced very uniform browning of hamburgers. Therefore, it can be seen that when using the same input conditions, the present bottom height and open recess configuration focuses and redirects the microwave energy toward the center of the dish bottom to produce more even and uniform browning through conduction with the foodstuffs retained within the dish.

Although the dish has been shown in the form of a rounded square, it may be circular, oval, rectangular or the like, and have a deeper configuration if desired. In addition, the channel or trough area may be discontinuous to provide extended but spaced-apart feet portions which peripherally bound a substantial portion of the bottom open recess. Further, even though we have now set forth a now preferred embodiment of our invention, various other changes and modifications may be made thereto without departing from the spirit and scope thereof as defined in the appended claims.

We claim:

1. A browning apparatus for use in combination with microwave ovens comprising a vessel of glass ceramic material, said vessel including sidewall portions and a central bottom wall portion, said central bottom wall portion being connected to said sidewall portion by inner bounding wall portions and a foot portion having a lowermost support surface, said central bottom wall portion having a lower surface provided with an electroconductive coating, said coated lower surface being vertically displaced above said lowermost support surface and forming a bottom-open recess in said vessel, and said bottom-open recess being substantially peripherally bounded by said inner bounding wall portions.

2. A microwave browning vessel as defined in claim 1 including a trough area surrounding an upper surface of said central bottom wall portion, said trough area being formed by said foot portion, said outer sidewall portion, and said inner bounding wall portion.

3. A browning vessel as defined in claim 1 wherein said coated lower surface is vertically displaced at an elevation above the elevation of said lowermost support surface with a distance of at least about 0.65 inches.

4. A browning vessel as defined in claim 1 wherein said inner bounding wall portion is continuous about the outer periphery of said bottom-open recess so as to completely surround the outer periphery of said bottom-open recess.

5. A method of uniformly browning foodstuff within a microwave oven comprising, providing a dish having an electroconductive coating on its bottom surface within the heating chamber of a microwave oven, positioning said bottom surface in elevated spaced relationship from a shelf of said heating chamber and forming an air pocket between said coated bottom surface and said shelf, supplying microwave energy to said heating chamber and uniformly distributing such microwave energy to said electroconductive coating by means of said air pocket and surrounding wall portions thereof, conducting heat from the energized electroconductive coating through the bottom portion of said vessel, and through conduction uniformly browning foodstuff in contact with said bottom portion.

6. A method of uniformly browning foodstuff within a microwave oven as defined in claim 5 including the step of focusing microwave energy supplied to said heating chamber toward central portions of the bottom of said vessel to more evenly distribute the heat supplied thereto and thereby minimize the temperature distribution across the bottom surface and provide more uniform browning of the foodstuff.

7. A method of uniformly browning foodstuff within a microwave oven as defined in claim 5 wherein said coated bottom surface is elevated in spaced relationship from the shelf of said heating chamber a distance of between about 0.65 inches and 1.3 inches.

* * * * *